US007870747B1

(12) United States Patent
Brown

(10) Patent No.: US 7,870,747 B1
(45) Date of Patent: Jan. 18, 2011

(54) FOGLESS AMBIENT AIR VAPORIZER

(75) Inventor: Ross M. Brown, Murrieta, CA (US)

(73) Assignee: Cryoquip, Inc., Murrieta, CA (US)

( * ) Notice: Subject to any disclaimer, the term of this patent is extended or adjusted under 35 U.S.C. 154(b) by 491 days.

(21) Appl. No.: 11/127,565

(22) Filed: May 13, 2005

(51) Int. Cl.
*F17C 9/02* (2006.01)

(52) U.S. Cl. ..... 62/50.2

(58) Field of Classification Search ..... 62/50.2
See application file for complete search history.

(56) References Cited

U.S. PATENT DOCUMENTS

| | | | | |
|---|---|---|---|---|
| 872,129 | A | 11/1907 | Heffley | |
| 3,124,940 | A | 3/1964 | Guelton | |
| 3,435,623 | A * | 4/1969 | Tyree Lewis, Jr | 62/50.2 |
| 3,633,374 | A | 1/1972 | Canter | |
| 3,735,465 | A | 5/1973 | Tibbetts et al. | |
| 3,978,663 | A * | 9/1976 | Mandrin et al. | 60/728 |
| 4,133,184 | A | 1/1979 | Bivins, Jr. | |
| 4,271,617 | A | 6/1981 | Yoshizawa | |
| 4,329,842 | A * | 5/1982 | Hoskinson | 60/39.465 |
| 4,766,736 | A | 8/1988 | Waldschmidt | |
| 5,291,738 | A * | 3/1994 | Waldrop | 62/617 |
| 7,137,623 | B2 | 11/2006 | Mockry et al. | |

* cited by examiner

*Primary Examiner*—Cheryl J Tyler
*Assistant Examiner*—John F Pettitt
(74) *Attorney, Agent, or Firm*—William W. Haefliger

(57) ABSTRACT

In the method of using ambient air to vaporize liquefied gas, the steps include transferring heat from a stream of ambient air to a stream of liquefied gas, thereby cooling the air stream, and vaporizing the liquid; transferring heat from a source into the cooled air stream; and then discharging the heated air stream to atmosphere, sufficient heat being transferred to obviate objectionable fog production resulting from step c).

7 Claims, 3 Drawing Sheets

FOGLESS AMBIENT AIR VAPORIZER

BACKGROUND OF THE INVENTION

This invention relates generally to overcoming the problem of fog production during or as a result of vaporization of liquefied gases, as for example liquefied natural gas (LNG), nitrogen, oxygen, and ethylene.

Liquefied gases (for example those listed above) frequently require heating to convert the liquid back into gas, for use. Conventionally, this heating process is referred to as vaporization and the devices employed as vaporizers.

One of the most common and least expensive sources of heat is ambient air. Many of the liquefied gases are stored at temperatures below the freezing point of water. Thus heat exchanges with ambient air can produce large amounts of cold air and, in certain atmospheric conditions, a ground fog. Most applications are small enough that the fog can be readily dissipated, but some are so large that the fog forms a hazard or nuisance. A good example is a receiving and re-gasification terminal for LNG (Liquefied Natural Gas). These facilities can have heat requirements in excess of 500,000,000 BTU/hr. Traditional methods of vaporization take a portion of the product stream, and burn it to produce the required heat. This can consume up to about 3% of the vaporized product and represents a substantial operating cost.

Additionally, new restrictions on NOx reduction have made combustion vaporization more difficult to live within the air pollution requirements at the re-gasification sites. The use of ambient air in conjunction with conventional heating systems has enormous appeal from both an economic and air pollution standpoint, if the fog issues can be overcome.

SUMMARY OF THE INVENTION

It is a major object of the invention to provide an efficient, low-cost solution to the above described problem. Basically, the invention provides a method, and apparatus, of using ambient air to vaporize liquefied gas, without objectionable resulting fog production. Steps of the basic method include:

a) transferring heat from a stream of ambient air to a stream of liquefied gas, thereby cooling the air stream, and vaporizing the liquid, b) transferring heat from a source into the cooled air stream, c) and then discharging the heated air stream to atmosphere, d) sufficient heat being transferred in step b) to obviate objectionable fog production resulting from step c).

Additional steps may be provided and include one of more of the following:

i) removing water from the cooled air stream, ii) providing and operating a vaporizer in which step a) is effected; providing and operating a re-heater in which said step b) is effected; and providing ducting to conduct flow of cooled air from the vaporizer to the re-heater, iii) providing and operating a back-up vaporizer for use while the first mentioned vaporizer is operated in thaw mode, for de-icing, iv) supplying liquefied gas to the vaporizer, and flowing vaporized gas from the vaporizer, the gas consisting of at least one of the following: LNG, nitrogen, oxygen, methane, ethylene, and mixtures thereof, v) providing a heat source, for the re-heater, to comprise a fuel fired back-up unit, or a fuel fired duct heater; or a source of stored heat; or waste heat from an electrical power plant; or waste heat from a cogeneration installation.

These and other objects and advantages of the invention, as well as the details of an illustrative embodiment, will be more fully understood from the following specification and drawings, in which:

DRAWING DESCRIPTION

DETAILED DESCRIPTION

Figure 1:
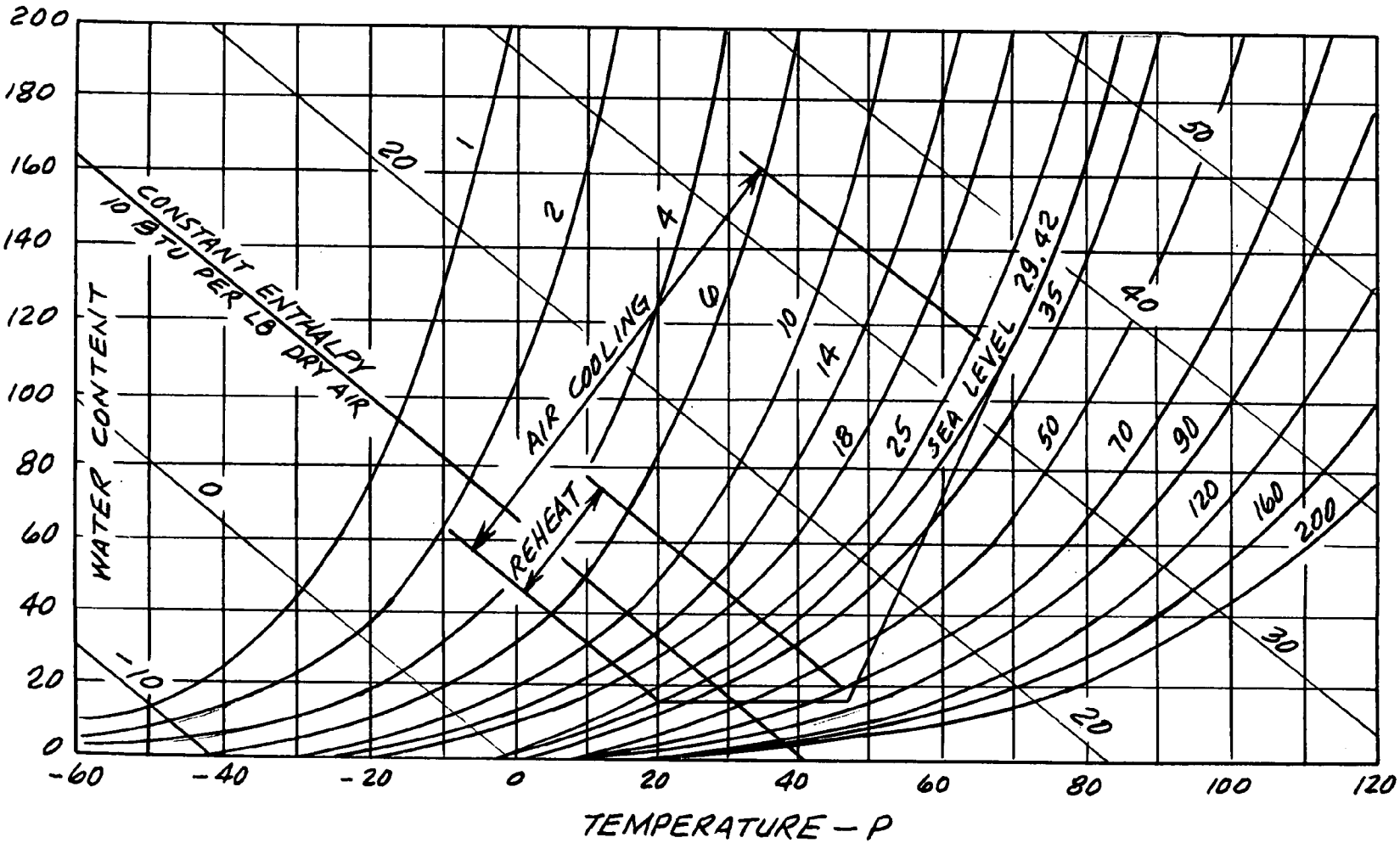
FIG. 1 is a psychometric chart.

The process can best be understood by referring to a conventional psychometric chart (see FIG. 1). If the ambient air is saturated (100% relative humidity) and cooled, the result will be a saturated stream at a lower temperature. Any time two saturated streams of different temperatures are mixed (as is the case when the cold stream is reintroduced to the environment), the result is a precipitate, usually in the form of fog. However, if the cold air is slightly reheated, the mixing in any portion escapes the precipitation and hence the condition to form fog.

Figure 2:
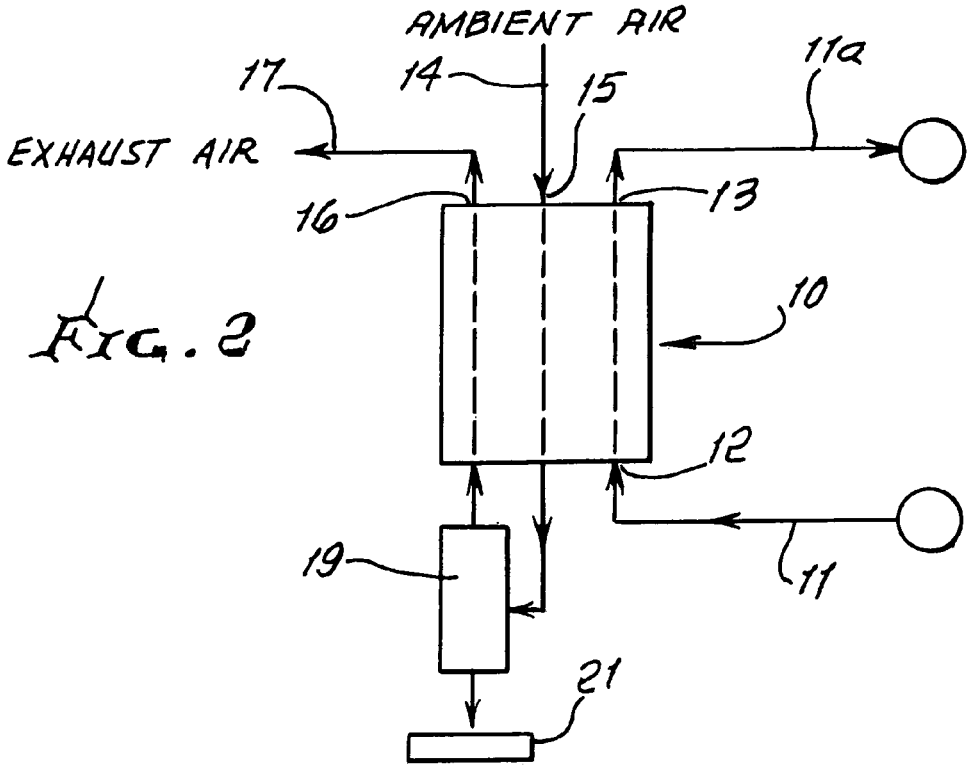
FIG. 2 is a schematic view of liquefied gas vaporizer unit to which ambient air is supplied.

As shown in FIG. 2, a first heat transfer apparatus, such as vaporizer 10, receives a liquid or liquefied gas stream 11, at inlet 12, and discharges a stream 11*a* of vaporized gas via outlet 13. Vaporization occurs by virtue of heat transfer from ambient (or near ambient temperature) air 14 entering the vaporizer at inlet 15 and exhausted from the vaporizer via outlet 16. The cooled air exhaust is indicated at 17. Typically, water is condensed from the air stream in the vaporizer, and may be separated as via a separator 19, for commercial utilization, or other use, as indicated at 21.

Figure 3:
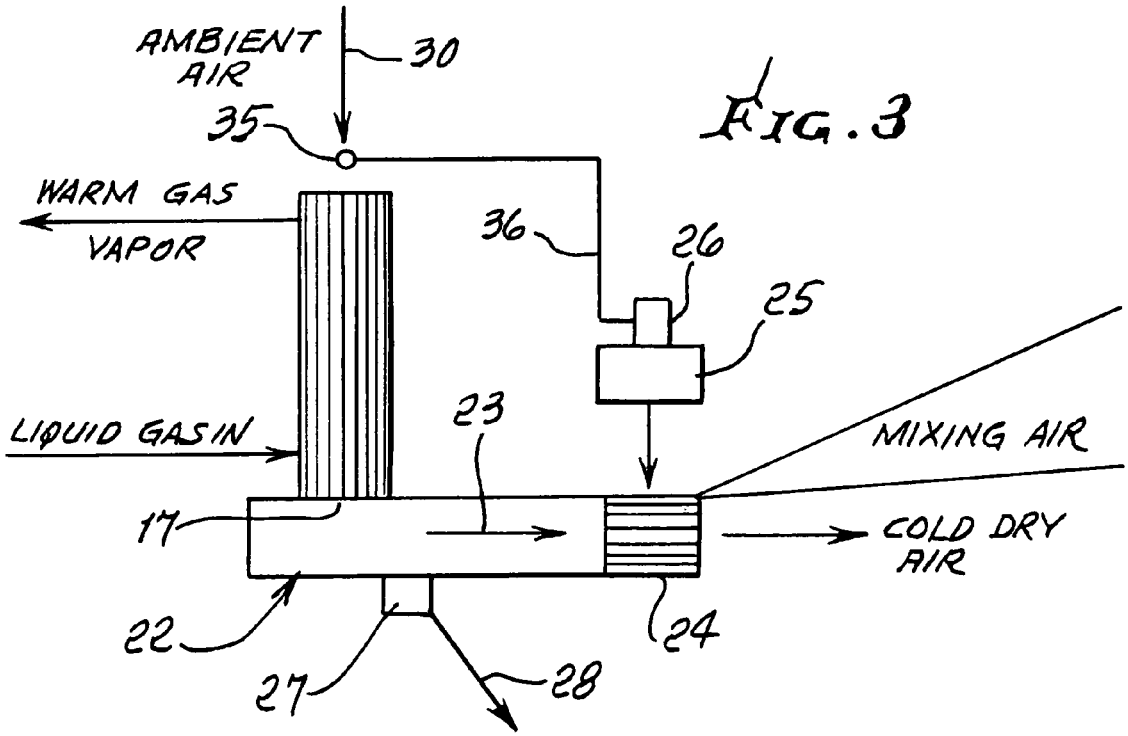
FIG. 3 is a schematic view of preferred system or apparatus incorporating the invention.

As shown in FIG. 3, the cooled air exhaust 17 enters a duct 22, and flows at 23 to a re-heater 24 (a heat exchanger) at which, or in which, heat is transferred into the cooled air stream. Sufficient heat is received by the air stream 23 to raise the air temperature to a level $T_2$, which is less than the temperature $T_1$ of the supplied ambient air 14, as to obviate objectionable fog production that would otherwise be produced by discharging the cooled air stream to atmosphere. A heat source for the re-heater is indicated at 25, and a control 26 may be used to control the heat supply, to achieve the selected temperature level $T_2$ of the air stream discharged from the re-heater. Water in the air flow 23 may be removed as indicated by collection zone 27, and discharged at 28, below the duct. See also FIG. 1. The control 26 may be governed, as for example from a set point, in response to variations in the temperature and humidity of the ambient air 14 supply, and in relation to the amount of ambient air supplied (pumped as at 30) per time interval, to adjust the amount of heat supplied to the re-heater, to optimize the level of heating of the cooled air to prevent fogging. Such controlling is indicated by ambient air parameter sensor or sensors at 35, and their connection at 36 to control 26.

The amount of energy required to reheat varies depending on the ambient temperature and relative humidity. At an ambient temperature of 70° F. and 100% relative humidity, and a 20° F. air exhaust temperature, the energy requirement is only 30% of the energy required for full vaporization. As the relative humidity decreases, the reheat requirement diminishes until at about 50% relative humidity; no reheating is required. As the ambient temperature decreases, the relative amount of reheat increases.

The energy for reheat can come from a variety of sources. Most vaporizer installations will have a certain number of operating hours below 32° F. (freezing point of water), which may preclude the ambient air for cycle de-icing of the vaporizer heat exchanger surfaces. As a result, a large installation is likely to have a fuel-fired backup vaporization system for those conditions. Partial use of this heating system is a likely source of the energy for reheat. Other possibilities include direct fuel-fired duct heaters, stored heat or the use of waste heat from electrical power plants or cogenerations installations. It is possible to use the ambient air itself to provide the reheat, but then the cold exhaust from it may require reheat. Theoretically, it is possible to provide a unit in which all the heat comes from ambient air.

Figure 4:
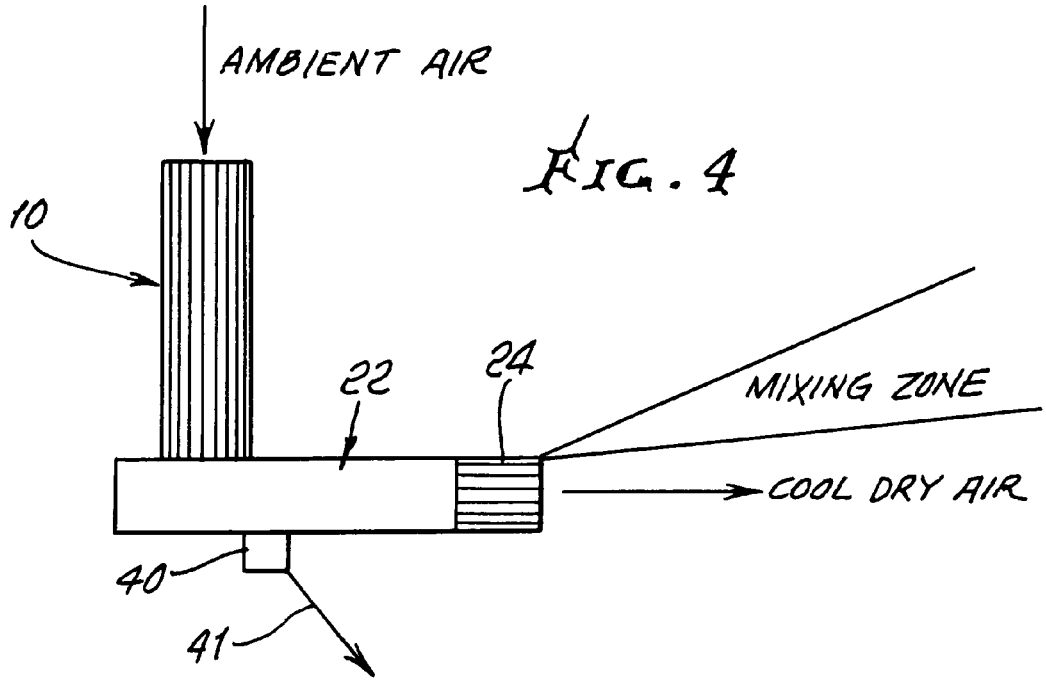
FIG. 4 is a view like FIG. 3, but showing operation in thaw mode.

FIG. 4 shows the vaporizer of FIG. 3 operating in thaw (de-icing) mode, in which ambient air is passed through the vaporizer, but liquid or liquefied gas flow into the vaporizer is eliminated, whereby the un-cooled ambient air flow melts accumulated ice. See ice and ice water removal at 40 and 41.

Figure 5:
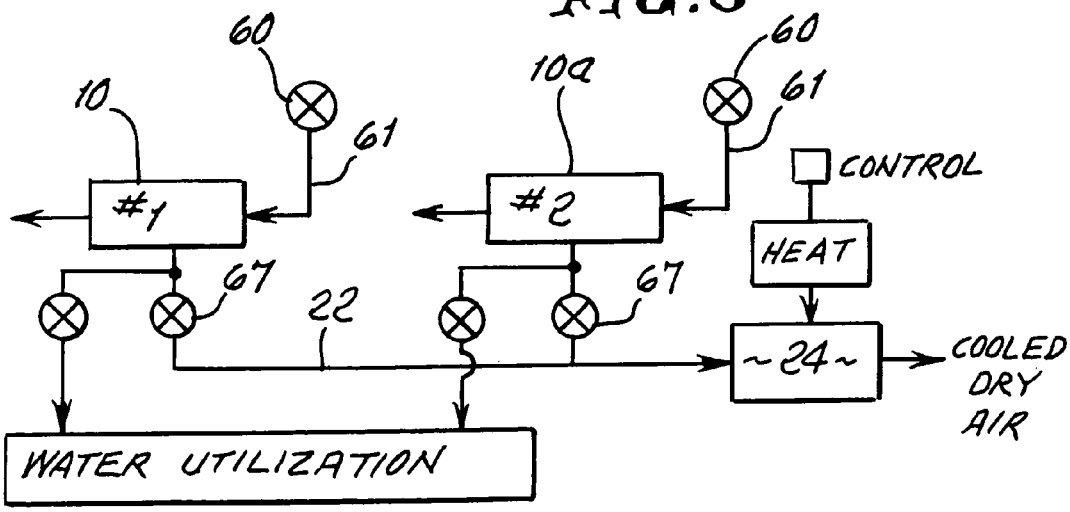
FIG. 5 is a block diagram showing operation of vaporizers in tandem, or selective operation of one vaporizer unit to allow thawing of a second unit, and water rejection.

In FIG. 5 first and second vaporizers 10 and 10*a* are employed, each discharging cooled air via duct 22 to the re-heater 24, as referred to. The two vaporizers may be operated in tandem, as shown. Either one may be operated in thaw mode, as by shutting off of valve 60 in a liquefied gas supply line 61, and the other vaporizer may then be operated as a back-up vaporizer to vaporize the liquefied gas supply. See also ambient air discharge control valves 67.

I claim:

1. An apparatus for vaporizing LNG, the apparatus comprising:

a) a first transfer means for transferring heat from a stream of ambient air at atmospheric pressure and free of compressor effected compression to a stream of liquefied gas, thereby cooling the air stream, and vaporizing the liquid, b) a second heat transfer means connected in air stream flow series with said first heat transfer means for transferring heat from a heat source into the cooled air stream, said second heat transfer means including a heat exchanger directly duct connected with said air stream immediately after cooling thereof, said heat source being external to said heat exchanger, for transferring heat into the heat exchanger, c) an air outlet for heated air to be directly discharged to atmosphere after passing through said heat exchanger, d) said heat exchanger being operated to transfer sufficient heat into the cooled air stream to obviate fog production upon discharge of heated air to atmosphere, e) said heat exchanger being a re-heater sidewardly offset from a bottom outlet of said first transfer means that comprises an elongated upright vaporizer having an upper inlet for ambient air to flow downwardly in the vaporizer, there being a duct directly passing the cooled air stream from the bottom air outlet of the vaporizer to the re-heater which is spaced substantially horizontally from said bottom outlet, the re-heater having a cool air outlet discharging in a direction everywhere away from the vaporizer and away from said duct, there being a water collection zone directly below said duct, and a control for said heat source governed from a set point in response to variations in the temperature and humidity of the ambient air supply above the vaporizer, and in relation to the amount of ambient air supplied per unit time interval to the vaporizer, to adjust the amount of heat supplied to the re-heater, thereby to optimize the level of heating of the cooled air in the re-heater to prevent fogging.

2. The apparatus of claim 1 including additional means for removing water produced by operation of said first heat transfer means.

3. The apparatus of claim 1 including means for supplying liquefied gas to the first heat transfer means, and for removing vaporized gas from the first heat transfer means.

4. The apparatus of claim 3 including a back-up vaporizer for receiving the liquefied gas, during thawing of said first mentioned heat transfer means.

5. The apparatus of claim 1 wherein the heat source is a fuel fired duct heater.

6. The apparatus of claim 1 including means for supplying liquefied gas to the vaporizer, and for discharging vaporized gas from the vaporizer, said gas consisting of one of the following: LNG, nitrogen, oxygen, methane, ethylene, and mixtures thereof.

7. The apparatus of claim 1 including providing a second vaporizer having functions of the vaporizer of claim 1, and directly duct connected with said heat exchanger to flow cooled air thereto, the vaporizers both directly connected with the heat exchanger, the two vaporizers operating alternately in thaw mode.

* * * * *